US006522258B1

(12) United States Patent
Lott

(10) Patent No.: US 6,522,258 B1
(45) Date of Patent: Feb. 18, 2003

(54) GARAGE DOOR STATUS LIGHT SYSTEM

(76) Inventor: Kim R. Lott, 721 Post Lake Pl., Apt. #213, Apopka, FL (US) 32703

( * ) Notice: Subject to any disclaimer, the term of this patent is extended or adjusted under 35 U.S.C. 154(b) by 0 days.

(21) Appl. No.: 09/859,607

(22) Filed: May 17, 2001

(51) Int. Cl.[7] ..... G08B 21/00

(52) U.S. Cl. ..... 340/686.1; 340/545.1; 340/815.45; 340/540; 340/547; 340/538; 340/310.06; 340/310.08

(58) Field of Search ..... 340/686.1, 545.1, 340/815.45, 540, 547, 538, 310.06, 310.08

(56) References Cited

U.S. PATENT DOCUMENTS 5,798,681 A * 8/1998 Chang ..... 340/815.45
5,883,579 A * 3/1999 Schreiner et al. ..... 340/686
6,049,285 A * 4/2000 Mangal et al. ..... 340/686.1
6,166,634 A * 12/2000 Dean ..... 340/545.1
6,310,548 B1 * 10/2001 Stephens, Jr. et al. ..... 340/540
6,346,889 B1 * 2/2002 Moss ..... 340/686.1

* cited by examiner

*Primary Examiner*—Daniel J. Wu
*Assistant Examiner*—Tai T. Nguyen

(57) ABSTRACT

A garage door status light system comprises a garage door. The garage door is movable between a raised open orientation and a lowered closed orientation. A garage door opener is provided. The garage door opener allows the door to be selectively moved between the open orientation and closed orientation. An electrical outlet is provided adjacent to the opener. The opener is electrically powered through the outlet. Also provided is a magnetic sensor. The magnetic sensor has a fixed component. The magnetic sensor also has a movable component constituting a switch. A light is provided. Provided next is an electrical line. The electrical line runs between the electrical outlet, the magnetic sensor and the light. Last provided is a power transformer operatively associated with the garage door opener and the electrical outlet for powering the light.

1 Claim, 3 Drawing Sheets

FIG 1
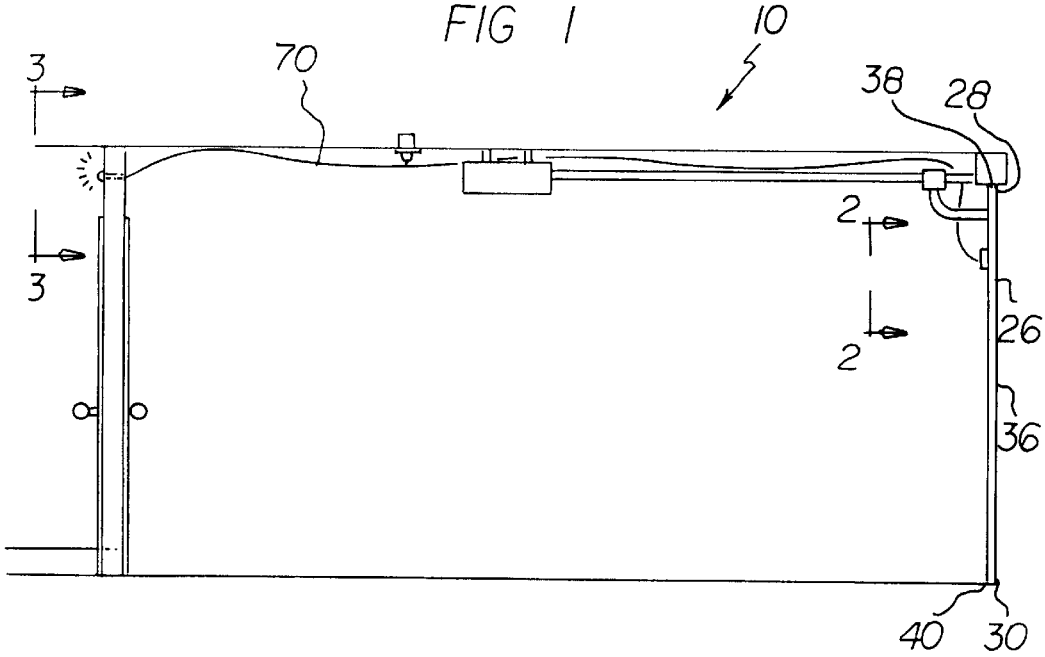
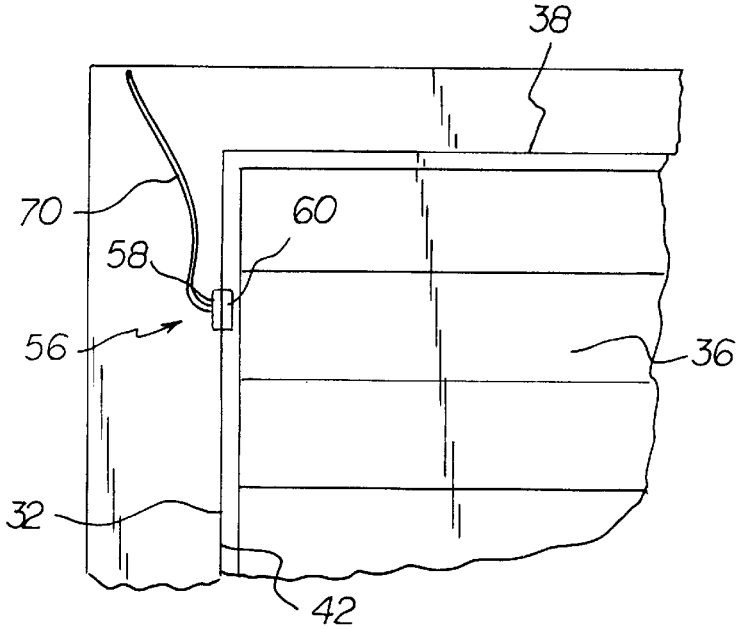
FIG 2

FIG 3
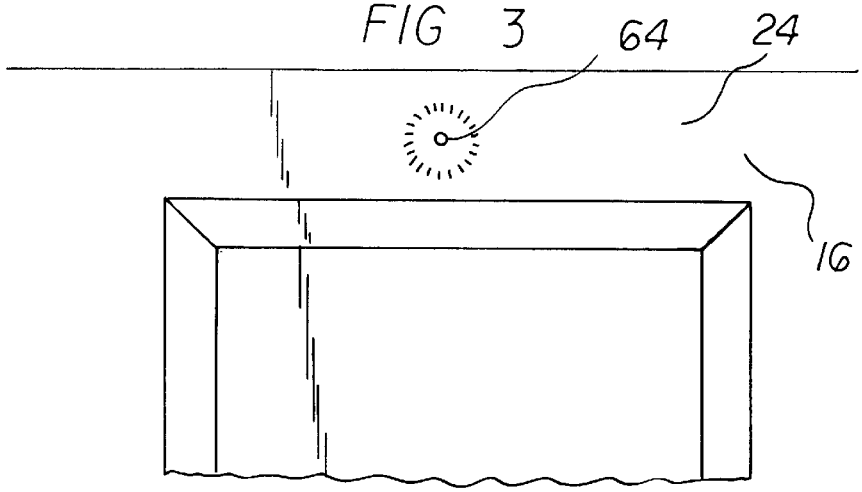
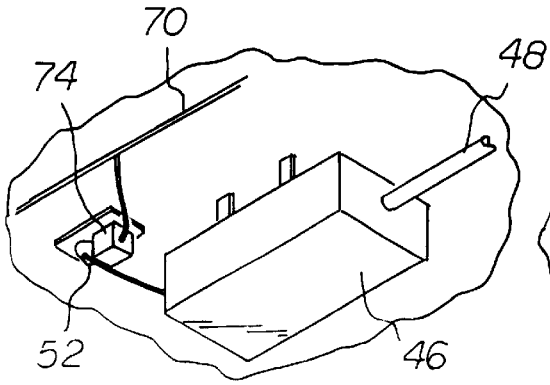
FIG 4
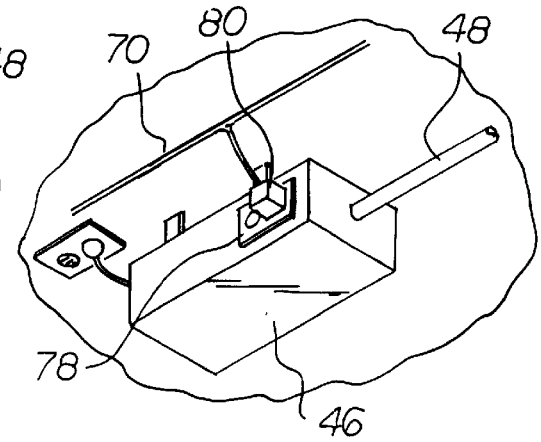
FIG 5

FIG 6
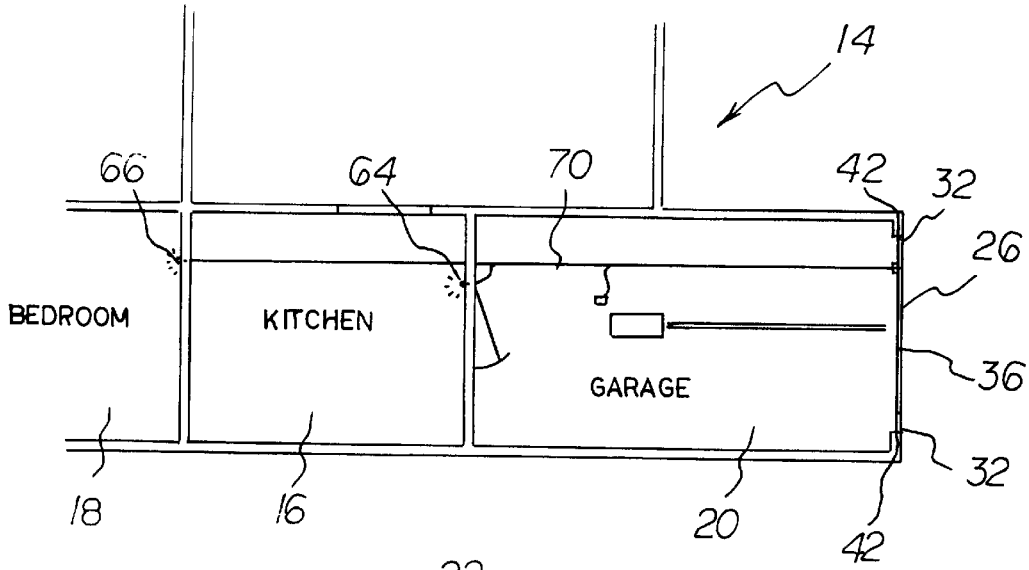
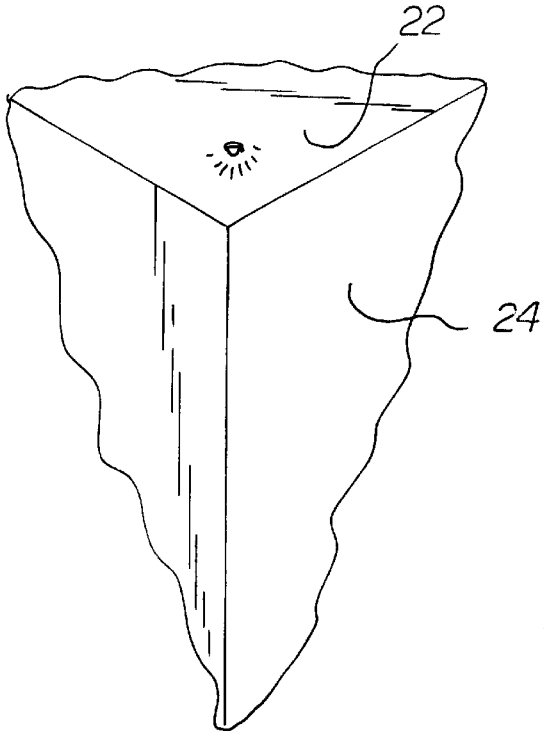
FIG 7
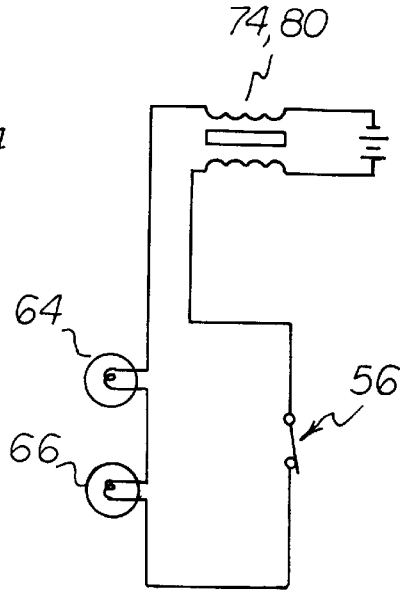
FIG 8

GARAGE DOOR STATUS LIGHT SYSTEM

BACKGROUND OF THE INVENTION

1. Field of the Invention

The present invention relates to a garage door status light system and more particularly pertains to providing an indoor light signal when a garage door is open.

2. Description of the Prior Art

The use of lighting systems of known designs and configurations is known in the prior art. More specifically, lighting systems of known designs and configurations previously devised and utilized for the purpose of signaling the status of electrical systems by conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,781,107 to Ji discloses an alarm device for an automatic garage door and U.S. Pat. No. 5,689,236 to Kister discloses a remote garage door position indicator.

While these devices fulfill their respective, particular objectives and requirements, the aforementioned patents do not describe a garage door status light system that allows for providing an indoor light signal when a garage door is open.

In this respect, the garage door status light system according to the present invention substantially departs from the conventional concepts and designs of the prior art, and in doing so provides an apparatus primarily developed for the purpose of providing an indoor light signal when a garage door is open.

Therefore, it can be appreciated that there exists a continuing need for a new and improved garage door status light system which can be used for providing an indoor light signal when a garage door is open. In this regard, the present invention substantially fulfills this need.

SUMMARY OF THE INVENTION

In view of the foregoing disadvantages inherent in the known types of lighting systems of known designs and configurations now present in the prior art, the present invention provides an improved garage door status light system. As such, the general purpose of the present invention, which will be described subsequently in greater detail, is to provide a new and improved garage door status light system and method which has all the advantages of the prior art and none of the disadvantages.

To attain this, the present invention essentially comprises a house. The house has a plurality of rooms including a kitchen, a bedroom, and a garage. Each room has a ceiling. Each room also has a plurality of walls. The garage has an enlarged garage door opening. The opening has a horizontal upper edge and a horizontal lower edge. Between the upper and lower edges is a pair of vertical side edges. Next provided is a garage door. The garage door has a horizontal upper edge and a horizontal lower edge. Between the upper and lower edges is a pair of vertical side edges. The garage door is movable between a raised open orientation remote from the garage door opening and a lowered closed orientation filling garage door opening. A garage door opener is provided. The garage door opener is mounted to the ceiling of the garage. A driver is coupled to the garage door. The door is selectively movable between the open orientation and the closed orientation. An electrical outlet is provided next. The electrical outlet is provided in the ceiling of the garage adjacent to the opener. The opener is electrically powered through the outlet. Provided next is a magnetic sensor. The magnetic sensor has a fixed component and a movable component. The fixed component is coupled to the garage on a vertical edge of the opening adjacent to the top edge. The movable component is coupled to the garage door on a vertical edge adjacent to the top edge. The magnetic sensor constitutes a normally closed switch adapted to allow current to pass there through when the fixed and movable components are not adjacent to each other and not magnetically coupled as when the garage door is open. The magnetic sensor is adapted to preclude current from passing therethrough when the fixed and movable components are adjacent to each other and magnetically coupled as when the garage door is closed. Next provided are one or more light emitting diodes. The light emitting diode or diodes are provided at a location or locations remote from the garage door. One light emitting diode is preferably mounted in a wall of the kitchen adjacent to the ceiling. Another light emitting diode is preferably mounted in the ceiling of the bedroom adjacent to a wall. Further provided is an electrical line. The electrical line constitutes an electrical connection between the electrical outlet, the magnetic sensor and the light emitting diodes. The electrical line is 22-gauge electrical bell wire. Last provided is a power transformer. The power transformer is operatively associated with the garage door opener and the electrical outlet. The transformer converts the 110-volt power from the outlet to 6-volt power. In this manner, the light emitting diodes are powered.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved garage door status light system which has all of the advantages of the prior art lighting systems of known designs and configurations and none of the disadvantages.

It is another object of the present invention to provide a new and improved garage door status light system which may be easily and efficiently manufactured and marketed.

It is further object of the present invention to provide a new and improved garage door status light system which is of durable and reliable constructions.

An even further object of the present invention is to provide a new and improved garage door status light system which is susceptible of a low cost of manufacture with regard to both materials and labor, and which accordingly is then susceptible of low prices of sale to the consuming public, thereby making such garage door status light system economically available to the buying public.

Even still another object of the present invention is to provide a garage door status light system for providing an indoor light signal when a garage door is open.

Lastly, it is an object of the present invention to provide a new and improved garage door status light system comprising a garage door. The garage door is movable between a raised open orientation and a lowered closed orientation. A garage door opener is provided. The garage door opener allows the door to be selectively moved between the open orientation and closed orientation. An electrical outlet is provided adjacent to the opener. The opener is electrically powered through the outlet. Also provided is a magnetic sensor. The magnetic sensor has a fixed component. The magnetic sensor also has a movable component constituting a switch. A light is provided. Provided next is an electrical line. The electrical line runs between the electrical outlet, the magnetic sensor and the light. Last provided is a power transformer operatively associated with the garage door opener and the electrical outlet for powering the light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a garage door status light system constructed in accordance with the principles of the present invention.

FIG. 2 is an enlarged view of the magnetic sensor of the present invention as taken along line 2—2 of FIG. 1.

FIG. 3 is a plan view of one of the light emitting diodes taken along line 3—3 of FIG. 1.

FIG. 4 is a perspective illustration of the garage door opener and electric outlet as shown in FIG. 1.

FIG. 5 is a perspective illustration of an alternate embodiment of the garage door opener and electric outlet as shown in FIG. 1.

FIG. 6 is a top plan view of a portion of a one story house in combination with the garage door status light system of the present invention, it being understood that multi-story houses or houses of any design could be equipped with the system of the present invention.

FIG. 7 is perspective view of the second light emitting diode associated with the present invention.

FIG. 8 is an electric schematic of the garage door status light system of the present invention.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved garage door status light system embodying the principles and concepts of the present invention and generally designated by the reference numeral 10 will be described.

The present invention, the garage door status light system 10 is comprised of a plurality of components. Such components in their broadest context include a garage door preferably operable by a garage door opener, an electrical outlet, a magnetic sensor, a light, an electrical line, and a power transformer. Such components are individually configured and correlated with respect to each other so as to attain the desired objective.

First provided is a house 14. The house has a plurality of rooms including a kitchen 16, a bedroom 18, and a garage 20. Each room has a ceiling 22. Each room also has a plurality of walls 24. The garage has an enlarged garage door opening 26. The opening has a horizontal upper edge 28 and a horizontal lower edge 30. Between the upper and lower edges is a pair of vertical side edges 32.

Next provided is a garage door 36. The garage door has a horizontal upper edge 38 and a horizontal lower edge 40. Between the upper and lower edges is a pair of vertical side edges 42. The garage door is movable between a raised open orientation remote from the garage door opening and a lowered closed orientation filling garage door opening.

A garage door opener 46 is provided. The garage door opener is mounted to the ceiling of the garage. A driver 48 is coupled to the garage door. The this manner, the door is selectively movable between the open orientation and the closed orientation.

An electrical outlet 52 is provided next. The electrical outlet is provided in the ceiling of the garage adjacent to the opener. The opener is electrically powered through the outlet.

Provided next is a magnetic sensor 56. The magnetic sensor has a fixed component 58 and a movable component 60. The fixed component is coupled to the garage on a vertical edge of the opening adjacent to the top edge. The movable component is coupled to the garage door on a vertical edge adjacent to the top edge. The magnetic sensor constitutes a normally open switch adapted to allow current to pass there through when the fixed and movable components are not adjacent to each other and not magnetically coupled as when the garage door is open. The magnetic sensor is adapted to preclude current from passing there through when the fixed and movable components are adjacent to each other and magnetically coupled as when the garage door is closed.

Next provided is a pair of light emitting diodes 64, 66. The light emitting diodes are provided at locations remote from the garage door. One light emitting diode 64 is mounted in a wall of the kitchen adjacent to the ceiling. The other light emitting diode 66 is mounted in the ceiling of the bedroom adjacent to a wall. Such room selection is for illustrative purposes only and the diodes could readily be placed in any room, including a hall or the like.

Further provided is an electrical line 70. The electrical line constitutes an electrical connection between the electrical outlet, the magnetic sensor and the light emitting diodes. The electrical line is 22-gauge electrical bell wire.

Last provided is a power transformer 74. The power transformer is operatively associated with the electrical line and the electrical outlet. The transformer converts the 110-volt power from the outlet to 6-volt power. In this manner, the light emitting diodes are powered.

An alternate embodiment is shown in FIG. 5. In such embodiment, a second electrical outlet 78 is provided on the opener. The electrical line is powered from the second outlet with the transformer 80 located between the line and the opener.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garage door status light system for providing an indoor light signal when a garage door is open comprising, in combination:

a house having a plurality of rooms including a kitchen and a bedroom and a garage, each room having a ceiling and a plurality of walls, the garage having an enlarged garage door opening with a horizontal upper edge and a horizontal lower edge and with a pair of vertical side edges there between;

a garage door having a horizontal upper edge and a horizontal lower edge and with a pair of vertical side edges there between, the garage door being movable between a raised open orientation remote from the garage door opening and a lowered closed orientation filling garage door opening;

a garage door opener mounted to the ceiling of the garage with a driver coupled to the garage door for selectively moving the door between the open orientation and the closed orientation;

an electrical outlet in the ceiling of the garage adjacent to the opener with the opener electrically powered through the outlet;

a magnetic sensor having a fixed component and a movable component, the fixed component being coupled to the garage on a vertical edge of the opening adjacent to the top edge, the movable component being coupled to the garage door on a vertical edge adjacent to the top edge, the magnetic sensor constituting a normally open switch adapted to allow current to pass there through when the fixed and movable components are not adjacent to each other and not magnetically coupled as when the garage door is open, the magnetic sensor adapted to preclude current from passing there through when the fixed and movable components are adjacent to each other and magnetically coupled as when the garage door is closed;

a pair of light emitting diodes at locations remote from the garage door, one light emitting diode being mounted in a wall of the kitchen adjacent to the ceiling and one light emitting diode being mounted in the ceiling of the bedroom adjacent to a wall;

an electrical line constituting an electrical connection between the electrical outlet and the magnetic sensor and light emitting diodes, such line being 22-gauge electrical bell wire allowing for the activation of the system with a 6-volt current; and a power transformer operatively associated with the garage door opener and the electrical outlet to transform 110-volt power from the outlet to 6-volt power for powering the light emitting diodes as well as the entire system.

* * * * *